US007511671B2

(12) United States Patent
Oodachi

(10) Patent No.: US 7,511,671 B2
(45) Date of Patent: Mar. 31, 2009

(54) PORTABLE WIRELESS APPARATUS

(75) Inventor: Noriaki Oodachi, Kawasaki (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 477 days.

(21) Appl. No.: 11/386,701

(22) Filed: Mar. 23, 2006

(65) Prior Publication Data

US 2006/0238425 A1 Oct. 26, 2006

(30) Foreign Application Priority Data

Mar. 23, 2005 (JP) ..... 2005-84396

(51) Int. Cl.
*H01Q 1/24* (2006.01)
*H01Q 1/38* (2006.01)

(52) U.S. Cl. ..... 343/702; 343/700 MS

(58) Field of Classification Search ..... 343/702, 343/700 MS, 795, 893
See application file for complete search history.

(56) References Cited

U.S. PATENT DOCUMENTS 5,649,306 A * 7/1997 Vannatta et al. ..... 455/575.7
7,009,567 B2 * 3/2006 Iwai et al. ..... 343/702
7,331,724 B2 * 2/2008 Hasegawa et al. ..... 396/348

FOREIGN PATENT DOCUMENTS

JP 2004-208219 7/2004
JP 2006-86875 3/2006

OTHER PUBLICATIONS

Kraus et al., "The Frequency-Independent Concept: Rumsey's Principle", Antennas For All Applications, 3rd Edition, Chapter 11, Section 4, pp. 386-387, (2002).
Notification of Reason for Rejection issued by the Japanese Patent Office on Aug. 19, 2008, for Japanese Patent Application No. 2005-084396, and English-language translation thereof.

* cited by examiner

*Primary Examiner*—Shih-Chao Chen
(74) *Attorney, Agent, or Firm*—Finnegan, Henderson, Farabow, Garrett & Dunner, L.L.P.

(57) ABSTRACT

There is provided with a portable wireless apparatus including a first casing including a first conductor plate; a second casing including a second conductor plate, wherein the first casing and the second casing being capable to rotate around a feed point, a coupler which couples the first casing and the second casing and a feed point which feeds power to the first and second conductor, disposed in close vicinity to the coupler, wherein, when the first and second conductor plates are rotated in same direction by 90 degrees around the feed point taken as a fulcrum in a state in which the two casings are opened to each other, the first and second conductor plates substantially coincide with shapes of spaces sandwiched between the first and second conductor plates before the rotation.

12 Claims, 16 Drawing Sheets

0 DEGREE

90 DEGREES

180 DEGREES

270 DEGREES

MARK
6: WIRELESS UNIT
3: CONDUCTOR PLATE
5: HIGH FREQUENCY POWER SUPPLY
4: CONDUCTOR PLATE
0 DEGREE

MARK
6: WIRELESS UNIT
3: CONDUCTOR PLATE
5: HIGH FREQUENCY POWER SUPPLY
4: CONDUCTOR PLATE
90 DEGREES

MARK
6: WIRELESS UNIT
3: CONDUCTOR PLATE
5: HIGH FREQUENCY POWER SUPPLY
4: CONDUCTOR PLATE
180 DEGREES

MARK
6: WIRELESS UNIT
3: CONDUCTOR PLATE
5: HIGH FREQUENCY POWER SUPPLY
4: CONDUCTOR PLATE
270 DEGREES

CONDUCTOR PLATE IS EQUAL TO BOARD IN SIZE

CONDUCTOR PLATE IS SMALLER THAN BOARD IN SIZE

CONDUCTOR PLATE IS LARGER THAN BOARD IN SIZE

OPEN STATE

CLOSED STATE

OPEN STATE (TOP VIEW)

CLOSED STATE (TOP VIEW)

PORTABLE WIRELESS APPARATUS

CROSS-REFERENCE TO RELATED APPLICATIONS

This application claims the benefit of priority under 35USC §119 to Japanese Patent Application No. 2005-84396 filed on Mar. 23, 2005, the entire contents of which are incorporated herein by reference.

BACKGROUND OF THE INVENTION

1. Field of the Invention

The present invention relates to a portable wireless apparatus, in particular, an antenna technique for portable wireless apparatus, to be more precise, a band widening technique for antenna.

2. Related Art

In portable wireless apparatuses in recent years, a plurality of wireless systems such as W-CDMA (Wideband Code Division Multiple Access) and PDC (Personal Digital Cellular) are mounted and a ground wave TV reception using a wide frequency band is conducted. From the viewpoint of antenna, an antenna operating in a wide band is necessary. It is an important technique for size reduction of the portable wireless apparatus to reduce the size of the antenna.

Under such a context, a planar dipole antenna effectively utilizing a structure of a folding portable telephone is proposed (for example, see Japanese Patent Application Laid-open 2002-377877). A high frequency power supply is installed between conductor plates in two casing, and two conductor plates are used as radiation elements of an antenna. Here, "conductor plate" means a conductor portion used as ground of a circuit board on which a wireless circuit and a data signal processing circuit are mounted.

As a feature of this configuration, the planar dipole antenna is implemented, and consequently wider band characteristics as compared with wire dipole antennas are obtained. Since conductor plates that are originally present in the portable telephone are utilized as radiation elements of the antenna, a separate antenna is not needed, and consequently a small-sized antenna can be implemented.

In the above-described configuration, however, the frequency bandwidth is restricted by the shape of the planar dipole antenna. Therefore, it is difficult to further improve the bandwidth. In the planar dipole antenna, there is a problem that the antenna characteristics change according to the shape of the conductor plates.

Thus, although the conventional technique aims at implementing a small-sized wide-band antenna, there is a problem that the frequency bandwidth is restricted by the shape of the planar dipole antenna. Furthermore, there is also a problem that the antenna characteristics are changed according to the shape of the conductor plates. Besides, there are subjects of raising the efficiency characteristics, raising gain characteristics, raising matching characteristics, raising isolation characteristics, reducing the weight, reducing the cost and increasing the elements.

SUMMARY OF THE INVENTION

According to an aspect of the present invention, there is provided with a portable wireless apparatus comprising: a first casing including a first conductor plate; a second casing including a second conductor plate, wherein the first casing and the second casing being capable to rotate around a feed point; a coupler which couples the first casing and the second casing; and a feed point which feeds power to the first and second conductor, disposed in close vicinity to the coupler, , wherein, when the first and second conductor plates are rotated in same direction by 90 degrees around the feed point taken as a fulcrum in a state in which the two casings are opened to each other, the first and second conductor plates substantially coincide with shapes of spaces sandwiched between the first and second conductor plates before the rotation.

According to an aspect of the present invention, there is provided with a portable wireless apparatus comprising: a first casing including a first conductor plate; a second casing including a second conductor plate, wherein the first casing and the second casing being capable to rotate around a feed point; a coupler which couples the first casing and the second casing; and a feed point which feeds power to the first and second conductor plates, disposed in close vicinity to the coupler, wherein the first and second conductor plates are configured to substantially function as a self-complementary antenna by being fed in a state in which the two casings are opened to each other.

DETAILED DESCRIPTION OF THE INVENTION

Hereafter, an embodiment will be described in detail with reference to the drawings.

Figure 1:
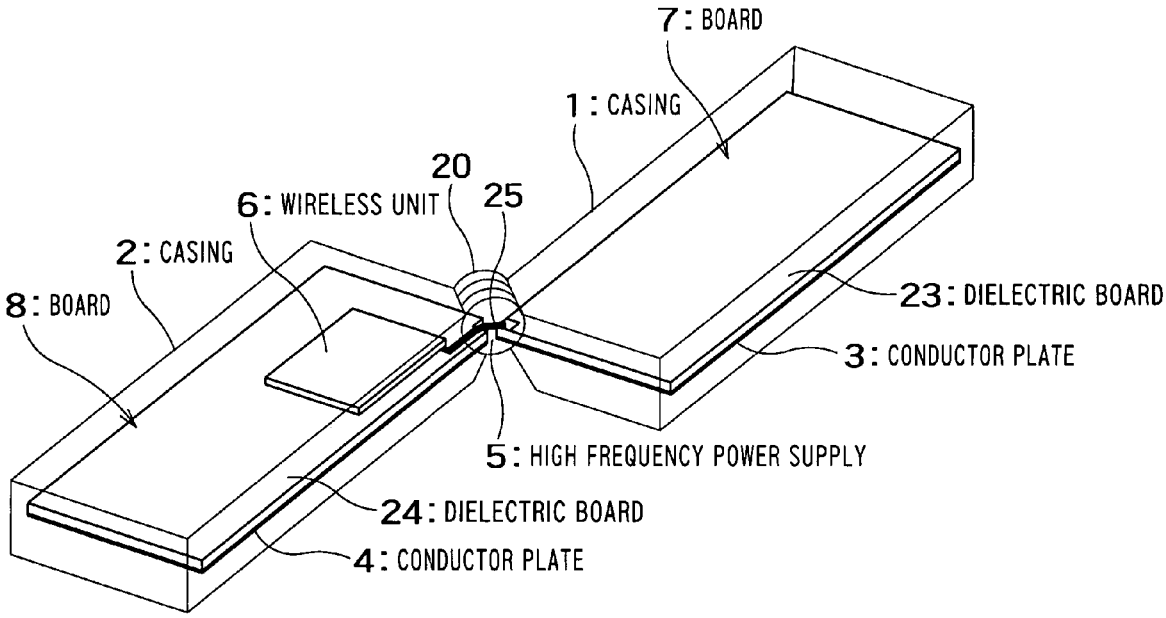
FIG. 1 is a diagram showing a configuration of a portable wireless apparatus according to the present invention.

FIG. 1 schematically shows a configuration of a portable wireless apparatus in the embodiment of the present invention.

This portable wireless apparatus has a configuration in which a casing 1 including a conductor plate 3 and a casing 2 including a conductor plate 4 can be folded via a coupler 20. The portable wireless apparatus includes a high frequency power supply (feed point) 5 which supplies (feeds) a high frequency voltage to the conductor plate 3 and the conductor plate 4. The conductor plate 3 and the conductor plate 4 serve as radiation elements of an antenna. In the state in which the casing 1 and the casing 2 are opened, the conductor plate 3 and the conductor plate 4 function as a self-complementary antenna in a near field region (for example, a region within a circle having a radius r2 from the position of the high frequency power supply 5) except an extremely near field (for example, a region within a circle having a radius r1(<r2) from the position of the high frequency power supply 5) of the high frequency power supply 5. This is a feature of the portable wireless apparatus. In other words, the conductor plate 3 and the conductor plate 4 are located on the same plane. If the conductor plate 3 and the conductor plate 4 are rotated around the position of the high frequency power supply taken as a fulcrum, by 90 degrees in the plane in which the conductor plate 3 and the conductor plate 4 exist, the shapes of the conductor plate 3 and the conductor plate 4 coincide with shapes of spaces sandwiched between the conductor plate 3 and the conductor plate 4 in the near field region except the extremely near field region of the high frequency power supply 5 before the rotation (see FIG. 5 described later). In other words, the conductor plate 3 and the conductor plate 4 function as an antenna by being fed from the high frequency power supply (feed point) 5, and the casing 1 and the casing 2 are coupled so as to cause the conductor plate 3 and the conductor plate 4 to become approximately point-symmetrical around the feed point. Owing to the configuration heretofore described, wideband characteristics of the antenna are obtained and restrictions on the shapes of the conductor plates can be reduced. Hereafter, components will be described in detail.

The casing 1 and the casing 2 are configured so as to be able to be folded using the coupler 20. According to the situation of use, the user can change the opening/closing state of the portable wireless apparatus. The opening/closing may be conducted manually, or may be conducted automatically using an open/close button. When transmitting and receiving radio waves by using the portable wireless apparatus, it is brought into an open state (the state shown in FIG. 1). When the antenna is not used, the portable wireless apparatus is used in a closed state. In the present embodiment, a high performance antenna is provided in use in the open state.

The casing 1 and the casing 2 are formed of a dielectric material such as plastics. A liquid crystal display, input buttons, a speaker, a microphone, a camera lens, and a call incoming light are not illustrated, but they are mounted on surfaces of the casing 1 and the casing 2. A board 7 and a board 8 are housed inside the casing 1 and the casing 2, respectively. The board 7 includes a laminated structure including a dielectric board 23 and a conductor plate 3. The board 8 includes a laminated structure of a dielectric board 24 and a conductor plate 4, and a wireless unit 6 disposed on the dielectric board 24. The wireless unit 6 generates a high frequency voltage, and supplies the generated high frequency voltage to the feed point 5. Besides, a communication data signal processing circuit, a battery and so on, which are not illustrated, are mounted on the dielectric boards 23 and 24.

The conductor plate 3 and the conductor plate 4 are ground plates having a reference potential in the board 7 and the board 8 incorporated respectively in the casing 1 and the casing 2. The ground boards typically exist in the whole of the board 7 and the board 8. Furthermore, in a multi-layer board, a ground layer exists in some layer. In FIG. 1, the conductor plates 3 and 4 are provided respectively under the dielectric boards 23 and 24 so as to expose one of surfaces.

Shapes of the dielectric boards may be the same as or different from shapes of the conductor plates. In the present embodiment, only the shapes of the conductor plates are prescribed as the lowest limit and consequently the conductor plates are caused to function as an antenna having high performance as described in detail later. Therefore, each of the dielectric boards may have an arbitrary shape.

The high frequency power supply (feed point) 5 is formed to provide a potential difference between the conductor plate 3 and the conductor plate 4. A feed line 25 is provided to supply a high frequency voltage from the wireless unit 6 mounted on the board 8 incorporated in the casing 2 to the feed point 5.

Figure 2A:
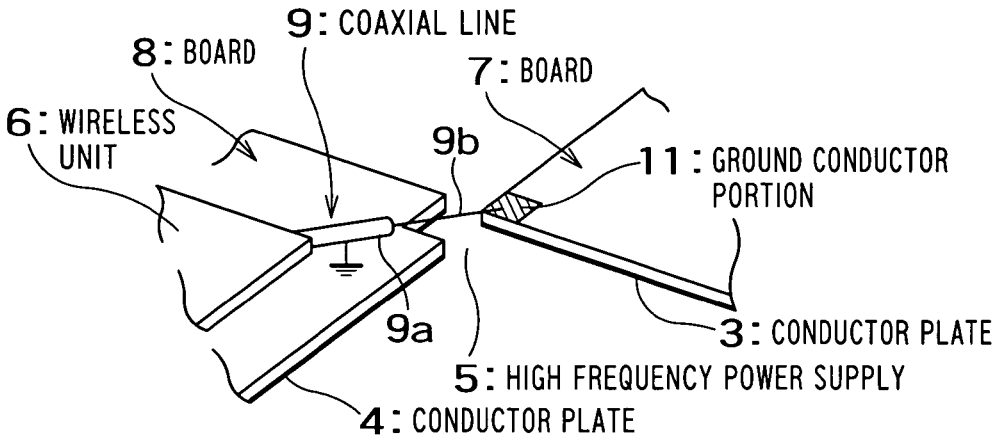
FIGS. 2A and 2B are diagrams showing structure examples of a high frequency power supply.
Figure 2B:
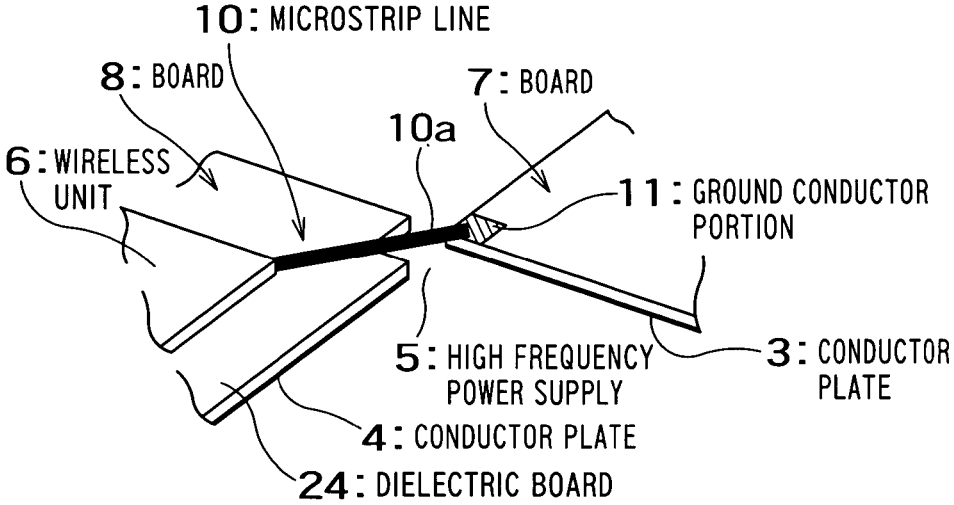

FIGS. 2A and 2B show representative configuration examples of the high frequency power supply.

FIG. 2A shows a configuration example of a high frequency power supply using a coaxial line.

The casings are omitted to prevent the drawings from becoming complicated. One end of an internal conductor 9*b* of a coaxial line 9 is connected to the wireless unit 6. An external conductor 9*a* of the coaxial line 9 is grounded to the conductor plate 4 by using arbitrary means. An insulator exists between the external conductor 9*a* and the internal conductor 9*b*. The other end of the internal conductor 9*b* of the coaxial line 9 is connected to the conductor plate 3. Here, however, the internal conductor 9*b* is not connected directly to the conductor plate 3, but connected to a ground conductor portion 11 disposed on the board 7. The ground conductor portion 11 is connected to the conductor plate 3 via means that are not illustrated.

FIG. 2B shows a configuration example of a high frequency power supply using a microstrip line.

A conductor wire 10*a* is disposed in parallel with the conductor plate 4 and the dielectric board 24. One end of the conductor wire 10*a* is connected to the wireless unit 6, and the other end of the conductor wire 10*a* is connected to the ground conductor portion 11. A microstrip line 10 is formed of a laminated structure including the conductor plate 4, the dielectric board 24 and the conductor wire 10*a*. The conductor wire 10*a* of the microstrip line 10 is connected to the ground conductor portion 11.

As a concrete example of the internal conductor 9*b* or the conductor wire 10*a*, a conductor of a material that is flexible to bending, for example, a soft conductor wire can be used. Despite opening/closing of the portable wireless apparatus, therefore, the high frequency power supply 5 does not fail and consequently stable connection is always possible. Similar effects can be obtained using polyethylene or ethylene tetrafluoride as the material of the insulator in the coaxial line 9.

Figure 3:
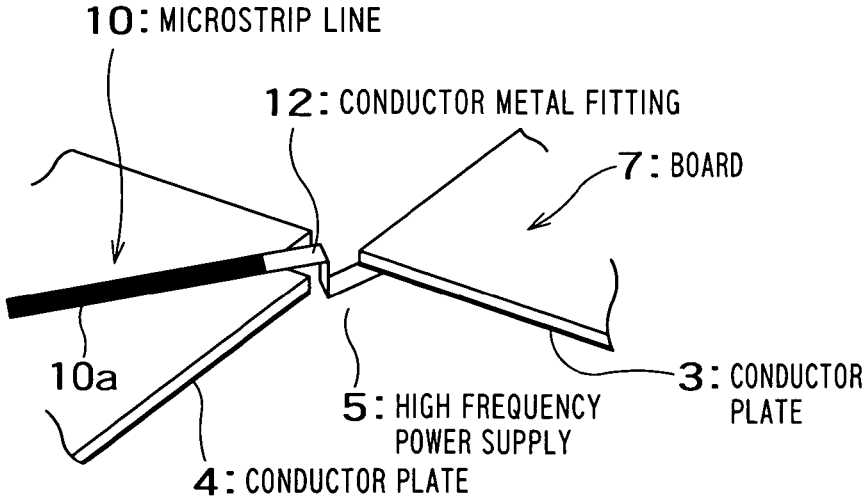
FIG. 3 is a diagram showing a structure example of a high frequency power supply.

In FIGS. 2A and 2B, the configuration in which the other end of the internal conductor 9*b* or the conductor wire 10*a* is connected to the ground conductor portion 11 is shown. Alternatively, a configuration in which the other end of the internal conductor 9*b* or the conductor wire 10*a* is not connected to the ground conductor portion 11, but the other end is connected directly to the conductor plate 3 may be used. In this case, a connection member may be interposed between the internal conductor 9*b* or the conductor wire 10*a* and the conductor plate 3. An example in which the conductor wire 10*a* is connected to the conductor plate 3 via a connection member is shown in FIG. 3.

A conductor metal fitting 12 having a predetermined shape is connected to the other end of the conductor wire 10*a* in the microstrip line 10. This metal fitting 12 is in contact with a surface of the conductor plate 3. When folding the casings, the contact between the metal fitting 12 and the conductor plate 3 is broken. In the state in which the casings are open, the metal fitting 12 is in contact with the conductor plate 3. When the casings are folded, therefore, problems are not caused by a twist or bending.

The shapes of the conductor plate 3 and the conductor plate 4 will now be described.

Figure 4:
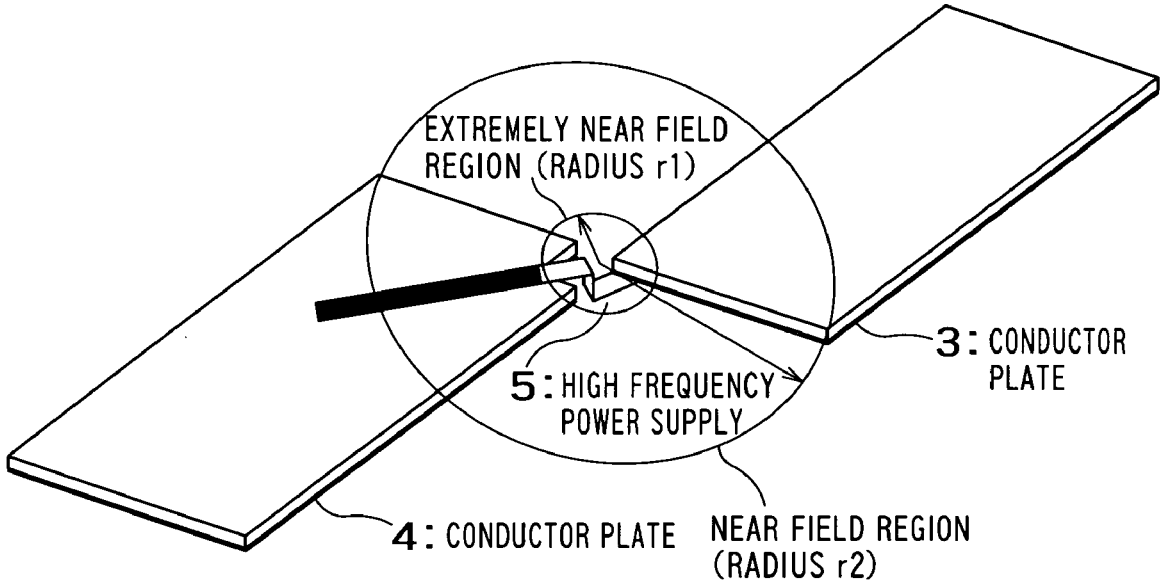
FIG. 4 is a diagram showing an extremely near field region and a near field region.

FIG. 4 is a diagram showing the extremely near field region and the near field region of the high frequency power supply 5.

The extremely near field region is a region including the high frequency power supply 5 which connects the conductor plate 3 to the conductor plate 4. The extremely near field region is a range of a circle having the radius r1 around the position of the high frequency power supply 5. The near field region corresponds to a portion that serves as the antenna. The near field region is a range of a circle having the radius r2 around the position of the high frequency power supply 5. The present embodiment has a feature in the shapes of the conductor plate 3 and the conductor plate 4 in the near field region except the extremely near field region, i.e., in the shapes of the conductor plate 3 and the conductor plate 4 in the range between the radius r1 and r2.

To be more precise, if the shapes of the conductor plate 3 and the conductor plate 4 are rotated around the position of the high frequency power supply 5 taken as a fulcrum, by 90 degrees in the plane in which the conductor plate 3 and the conductor plate 4 exist, the shapes of the conductor plate 3 and the conductor plate 4 coincide with shapes of spaces sandwiched between the conductor plate 3 and the conductor plate 4 in the near field region except the extremely near field region before the rotation. As a result, the conductor plate 3 and the conductor plate 4 function as a wideband antenna. As a matter of course, however, the present embodiment includes the case where the shapes of the conductor plate 3 and the conductor plate 4 nearly coincide with the shapes of the spaces as long as an effect that can be regarded as being derived from an effect obtained in the case of complete coincidence is obtained. The reason why the conductor plate 3 and the conductor plate 4 function as the wideband antenna is that the conductor plate 3 and the conductor plate 4 function as the self complementary antenna. Hereafter, the self-complementary antenna will be described in detail.

Figure 5:
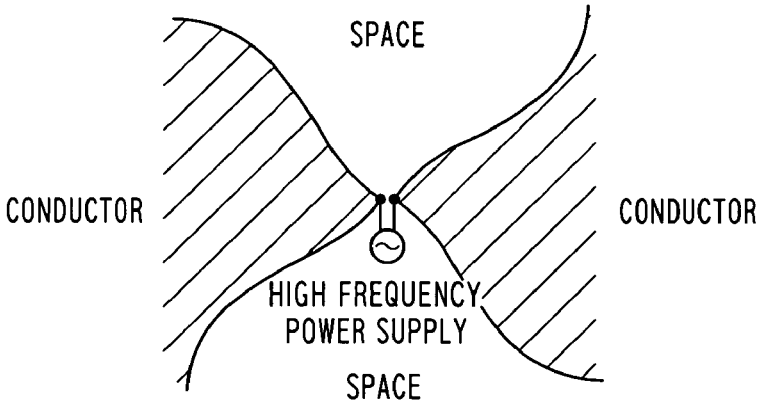
FIG. 5 is a diagram showing a schematic structure of a self-complementary antenna.

FIG. 5 shows a schematic structure of the self-complementary antenna.

In the self-complementary antenna, two planar conductor plates are used as radiation elements. Here, it is supposed that each conductor plate has an infinite size. If the shapes of the conductor plate 3 and the conductor plate 4 are rotated in the same direction around the position of the high frequency power supply 5 taken as a fulcrum, by 90 degrees in the plane in which the conductor plate 3 and the conductor plate 4 exist, the shapes of the conductor plate 3 and the conductor plate 4 coincide with shapes of spaces sandwiched between the conductor plate 3 and the conductor plate 4 before the rotation. The self-complementary antenna has such a feature. As long as this feature is satisfied, arbitrary shapes of the conductor plates can be selected. The self-complementary antenna having an arbitrary shape has a feature of having super wideband characteristics. Here, the super wideband characteristics mean that the input impedance has a constant value of $60\pi$ (=188) Ω without depending upon the frequency.

As shown in FIG. 4, the conductor plate 3 and the conductor plate 4 are disposed so as to satisfy the principle of the self-complementary antenna in the near field region except the extremely near field region. Therefore, the conductor plate 3 and the conductor plate 4 function as a super wideband antenna.

However, the foregoing description is theoretical. As a matter of fact, there is a frequency bandwidth in which the super wideband characteristics of the self-complementary antenna are implemented.

First, the frequency bandwidth in which the super wideband characteristics are implemented depends upon the precision of the structure located near the antenna. In the principle of the self-complementary antenna, the size of the high frequency power supply (feed point) is supposed to be infinitely small. As a matter of fact, however, the high frequency power supply has some size. For example, the high frequency power supply has a structure shown in FIG. 2A, 2B or 3, and has some size. In the extremely near field region of the high frequency power supply, therefore, the principle of the self-complementary antenna is not satisfied. Especially, in frequencies having short wavelengths, a difference in structure near the feed point exerts a great influence. If the radius r1 of the extremely near field region is one tenth of the wavelength at the highest frequency, the radius r1 becomes one fifth of the half wavelength (five tenths). In the self-complementary antenna as well, the half wavelength becomes reference of the operation in the same way as the dipole antenna. Even if one fifth of the dimension of the self-complementary antenna is occupied by the feed point, therefore, operation of a favorable antenna is obtained. If the radius r1 of the extremely near field region is made equal to one tenth or less of the wavelength at the highest frequency, therefore, the conductor plates 3 and 4 function as the self-complementary antenna even at the highest frequency.

Secondly, the frequency bandwidth in which the super wideband characteristics are implemented depends on the maximum dimension of the antenna. The self-complementary antenna is supposed in principle to have an infinite large size. As a matter of fact, however, the self-complementary antenna is formed using conductor plates each having a finite size. It is known to be necessary that each of the conductor plates has a length of at least one fourth of the wavelength from the position of the high frequency power supply in order to function as the self-complementary antenna. Therefore, the finite size of the conductor plates depends on the lowest operation frequency having a long wavelength. By making the radius r2 of the near field region equal to at least one fourth of the wavelength at the lowest operation frequency, therefore, the conductor plates 3 and 4 function as the self-complementary antenna even at the lowest operation frequency.

As appreciated from the foregoing description, the conductor plate 3 and the conductor plate 4 satisfy the principle of the self-complementary antenna in the near field region except the extremely near field region, in the open state of the portable wireless apparatus. Its operation frequency range is determined by the radius r1 of the extremely near field region and the radius r2 of the near field region.

Results of a simulation conducted by the present inventor on the wideband characteristics of the self-complementary antenna will now be described.

Figure 6:
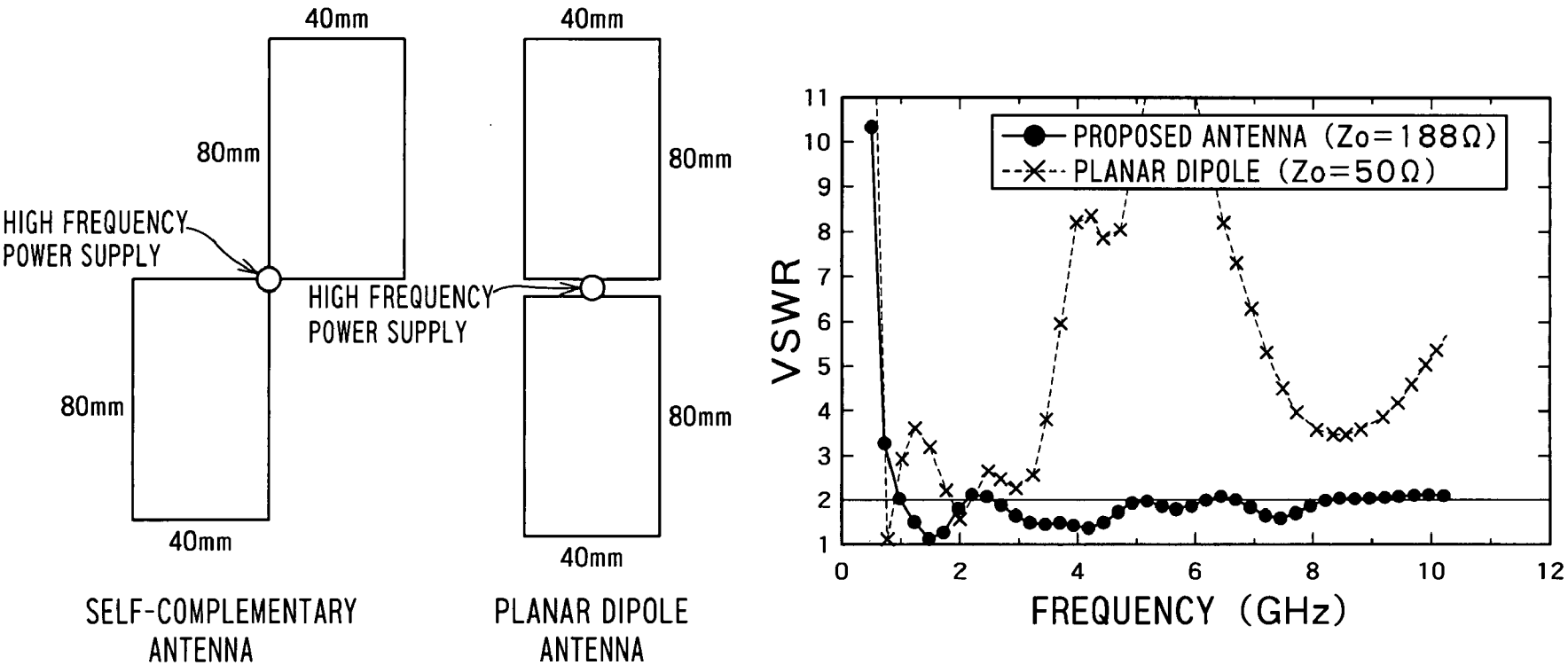
FIG. 6 is a diagram showing frequency characteristics of a self-complementary antenna.

FIG. 6 shows the VSWR (Voltage Standing Wave Ratio) as a function of the frequency. The VSWR represents the matching condition between the characteristic impedance of the feed line and the input impedance of the antenna. A smaller VSWR means better matching. Simulation results shown in FIG. 6 concern the self-complementary antenna according to the present invention and the planar dipole antenna used to for the purpose of comparison. In this simulation, only three portions, i.e., the conductor plate 3, the conductor plate 4 and the high frequency power supply 5 are modeled, and characteristics are evaluated.

Both the conductor plate 3 and the conductor plate 4 have a size of 40 mm by 80 mm. The high frequency power supply has a size (diameter) of 7 mm. Therefore, the radius r1 of the extremely near field region is r1=3.5 mm. A frequency at which 3.5 mm becomes equal to one tenth of the wavelength is 8.57 GHz.

The radius r2 of the near field region is made equal to r2=40 mm. A frequency at which 40 mm becomes equal to one fourth of the wavelength is 1.88 GHz.

The value of VSWR changes according to the characteristic impedance of the feed line. In the present simulation, a feed line having 60π (188 Ω) is used for the self-complementary antenna according to the present invention, and a feed line having 50 Ω is used for the planar dipole antenna. In FIG. 6, the characteristic impedance of the feed line is denoted by Zo.

The VSWR is found as described hereafter.

First, a reflection coefficient Γ is found according to $\Gamma=(Zin-Zo)/(Zin+Zo)$, where Zo is the characteristic impedance of the feed line, and Zin is the input impedance of the antenna.

Subsequently, the VSWR is calculated from the reflection coefficient Γ using the relation $VSWR=(1+|\Gamma|)/(1-|\Gamma|)$.

The minimum value of the VSWR is 1, and at this time, the characteristic impedance Zo of the feed line coincides with the impedance Zin of the antenna.

As appreciated from the simulation result shown in FIG. 6, wideband characteristics are obtained in the self-complementary antenna according to the present invention as compared with the planar dipole antenna. In FIG. 6, VSWR≦2 is a reference used when judging the operation frequency of the antenna. In the self-complementary antenna, the value of the VSWR is nearly kept at 2 or less in the range between approximately 1 GHz and approximately 9 GHz. It is indicated that wideband characteristics have been implemented. The frequency characteristics of the wideband antenna do not change abruptly. As a matter of fact, therefore, favorable characteristics are obtained in a range wider than operation frequencies prescribed by the size of the extremely near field region and the size of the near field region. On the other hand, although characteristics are repeated periodically in the planar dipole antenna, it is indicated in the planar dipole antenna that the frequency range in which the VSWR is small is extremely narrow as compared with the self-complementary antenna.

According to the present embodiment, the conductor plates are disposed respectively in the two casings configured to be able to be folded, so as to satisfy the principle of the self-complementary antenna in the open state of the casings, as heretofore described. As a result, super wideband characteristics can be implemented.

Figure 7:
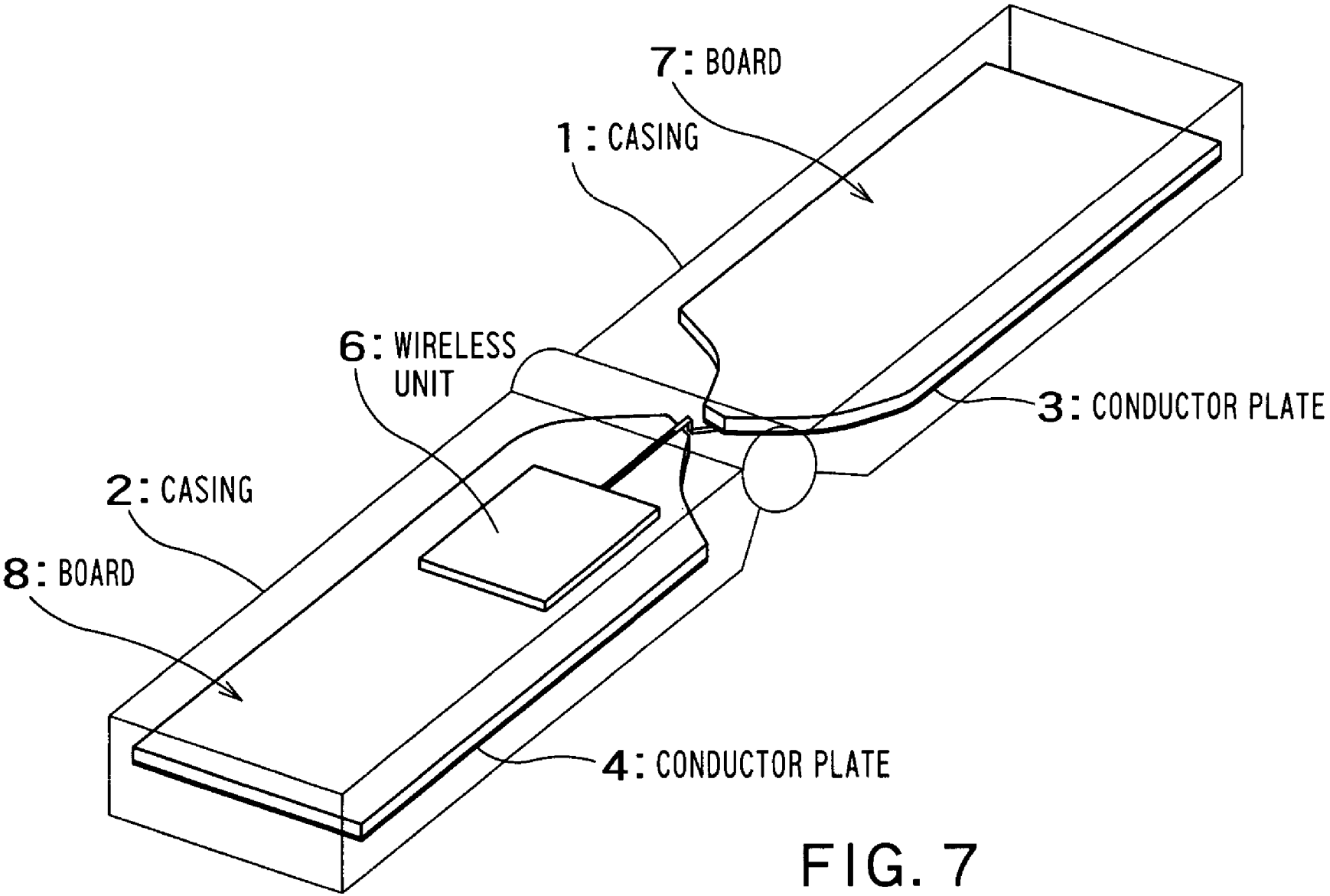
FIG. 7 is a diagram showing a configuration of a portable wireless apparatus differing from FIG. 1 in shapes of conductor plates.

Furthermore, according to the present embodiment, it does not matter which shapes the conductor plates have, as long as the principle of the self-complementary antenna is satisfied. Therefore, restrictions on the shapes of the conductor plates are reduced, resulting in effectiveness in practical use. Even if the conductor plates and the dielectric boards have shapes different from those shown in FIG. 1, for example, as shown in FIG. 7 which shows another configuration example, wideband characteristics are obtained.

Furthermore, according to the present embodiment, conductor plates, which originally exist in the portable wireless apparatus, are used as the radiation elements of the antenna. Unlike the conventional portable wireless apparatus, therefore, it is not necessary to provide an antenna separately. As a result, it becomes possible to reduce the size, weight and cost.

In the present embodiment as well, however, it is also possible to further mount an antenna different from the self-complementary antenna on the portable wireless apparatus and use these antennas properly according to the use.

Figure 8:
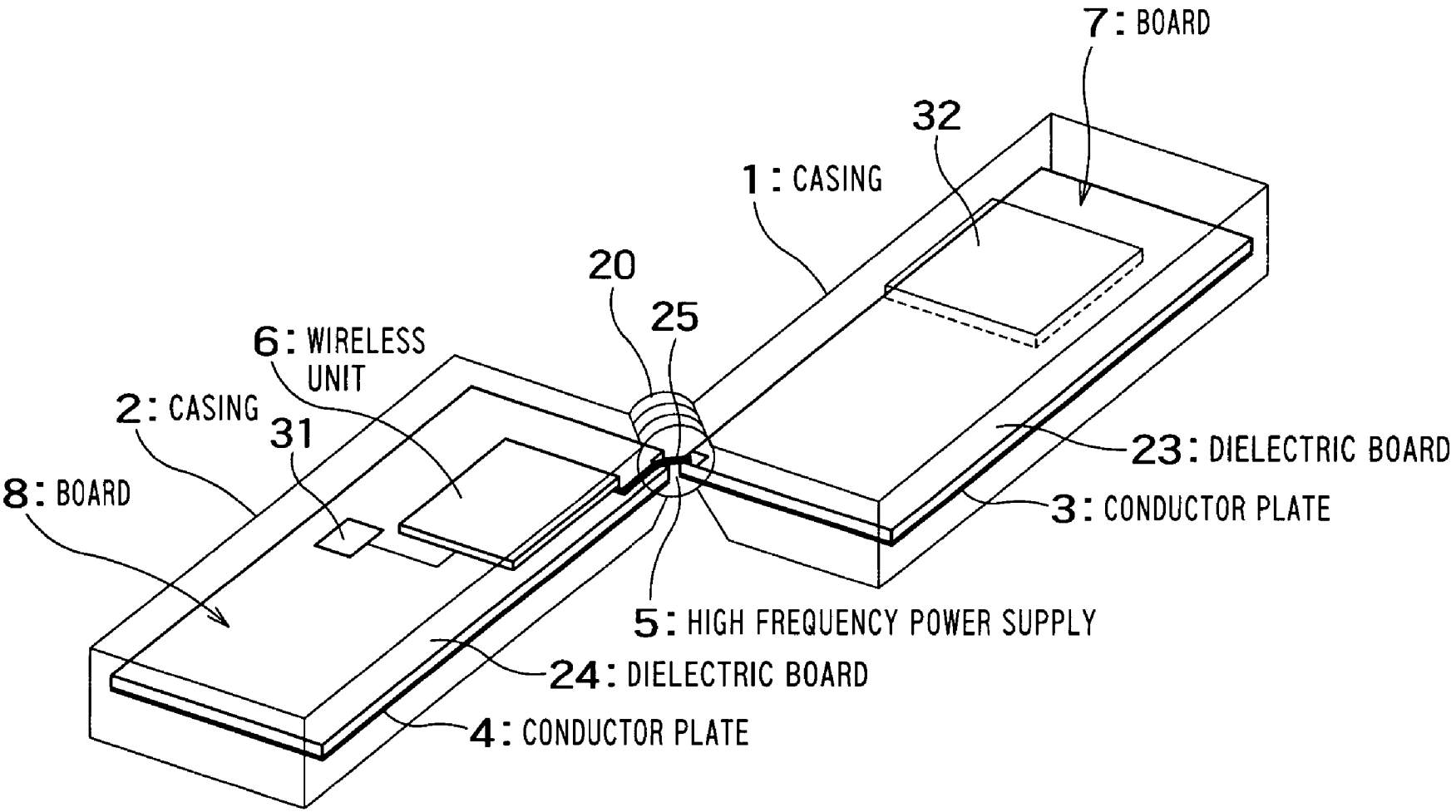
FIG. 8 is a diagram showing a configuration of a portable wireless apparatus which further includes a chip antenna mounted thereon.

For example, as shown in FIG. 8 which shows another configuration example of the portable wireless apparatus, a non-directional chip antenna 31 is connected to the wireless unit 6 and disposed on the dielectric board 24. When the portable wireless apparatus is used for telephone, the chip antenna 31 is used. When displaying a TV image on a display 32, the wideband self-complementary antenna is used. In other words, when the communication stability takes precedence as in telephone, the non-direction chip antenna 31 is used. On the other hand, when handling large capacity data, the self-complementary antenna is used to conduct fast communication.

By the way, in the portable wireless apparatus according to the present embodiment described heretofore, the input impedance of the antenna becomes 60π Ω because of the characteristics of the self-complementary antenna. Therefore, the impedance of the feed line does not match the input impedance of the antenna in some cases. In this case, an impedance conversion circuit should be inserted between the feed line and the feed point (for example, between the coaxial line and the exposed internal conductor shown in FIG. 2A) to attain the impedance matching. In the present invention, therefore, a feed line having an arbitrary characteristic impedance can be used.

It has been described that the conductor plate 3 and the conductor plate 4 function as the self-complementary antenna when they are present on the same plane. In some cases, manufacturing is facilitated by disposing the two conductor plates on different planes in the open state of the casings or disposing the conductor plates so as to provide one of the conductor plates with an angle of some degree as compared with the other of the conductor plates. At this time, at the sacrifice of degradation of the VSWR characteristics, in the open state, the two conductor plates may be disposed on different planes in the open state or the two conductor plates may be disposed with an angle of some degree between them. The present invention includes these cases.

Figure 9:
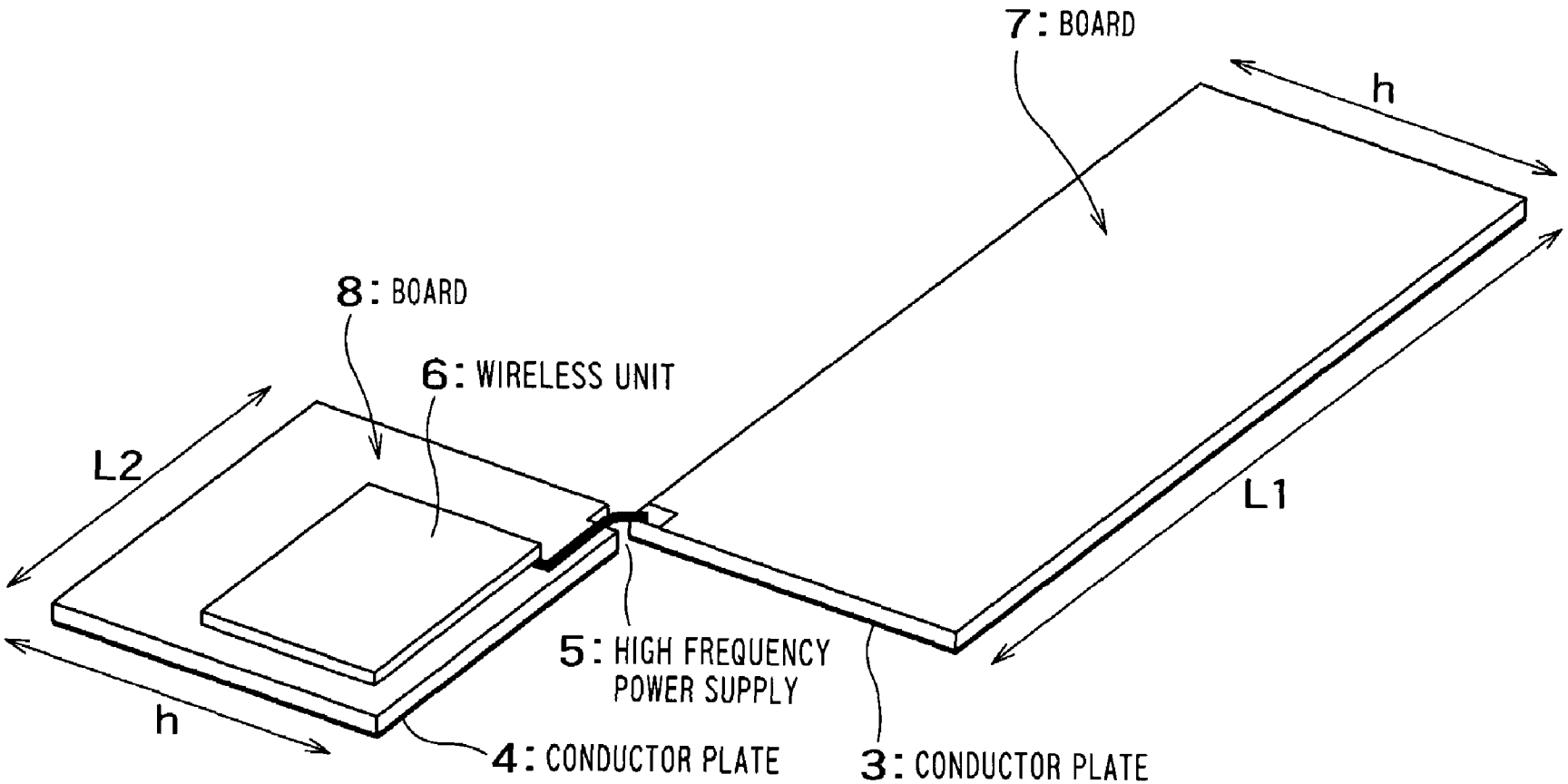
FIG. 9 is a diagram showing a configuration of a portable radio apparatus in which two conductor plates are different from each other in shape.

In the present embodiment heretofore described, the two conductor plates have the same shape (see FIG. 1 and FIG. 7). As described above, however, the shapes of the conductor plate 3 and the conductor plate 4 are arbitrary in regions outside the near field region. An example in which the two conductor plates are different in shape is shown in FIG. 9. In this example, the two conductor plates have the same conductor width h, but the two conductor plates have different lengths L1 and L2, respectively. Thus, even if the two conductor plates have different shapes, wideband characteristics can be obtained.

This point is a great advantage obtained unlike the planar dipole antenna. In the planar dipole antenna, the size of the whole structure greatly affects the characteristics. On the other hand, in the self-complementary antenna, the influence of the structure outside the near field region on the performance is slight provided that the structure of the near field region satisfies the principle of the self-complementary antenna. Therefore, it becomes possible to design the near field region of the high frequency power supply 5 from the viewpoint of the antenna performance and design a range far from the near field region, regarding the design and other functions as important without giving consideration to the antenna performance.

Because of such a feature, it becomes possible in the present invention to increase the kinds of the open state in the two casings. Hereafter, this will be described with reference to concrete examples.

FIGS. 10A to 10D are diagrams showing four kinds of patterns in the planar dipole antenna in the open state. FIGS. 11A to 11D are diagrams showing four kinds of patterns in the self-complementary antenna in the open state. Here, it is supposed that the conductor plate 3 and the conductor plate 4 have the same rectangular plane shape. In FIGS. 10 to 10D and FIGS. 11A to 11D, the conductor plate 3 is rotated with respect to the conductor plate 4 by 90 degrees in the cited order. In order to facilitate understanding the rotation state of the conductor plate 3, a mark is put on a corner on the conductor plate 3 for convenience. In FIGS. 10A to 10D and FIGS. 11A to 11D, connection between the feed line and the conductor plate 3 is conducted by contact. When the conductor plate 3 is rotated, therefore, the conductor plate 3 is separated from the feed line temporarily and the conductor plate 3 is brought into contact with the feed line again after the rotation.

Figure 10A:
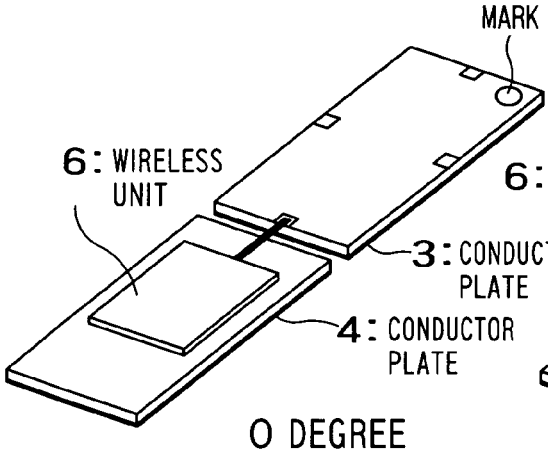
FIGS. 10A, 10B, 10C and 10D are diagrams showing arrangement patterns of conductor plates of a planar dipole antenna.
Figure 10B:
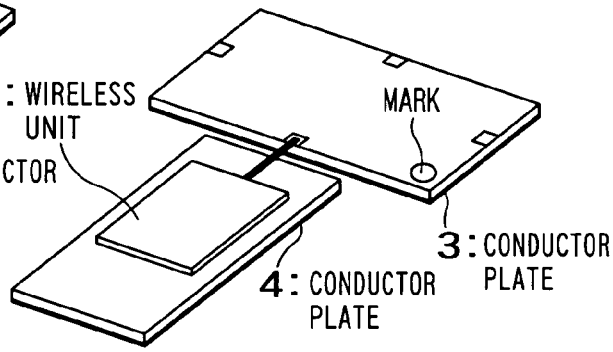
Figure 10C:
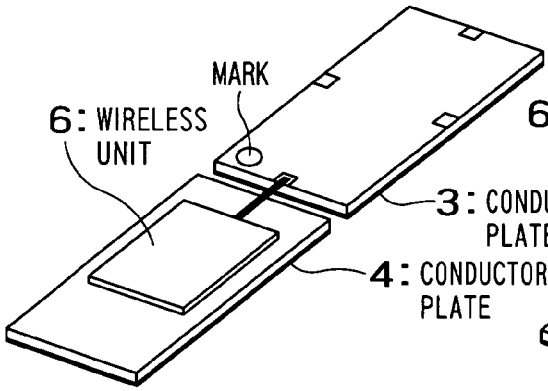
Figure 10D:
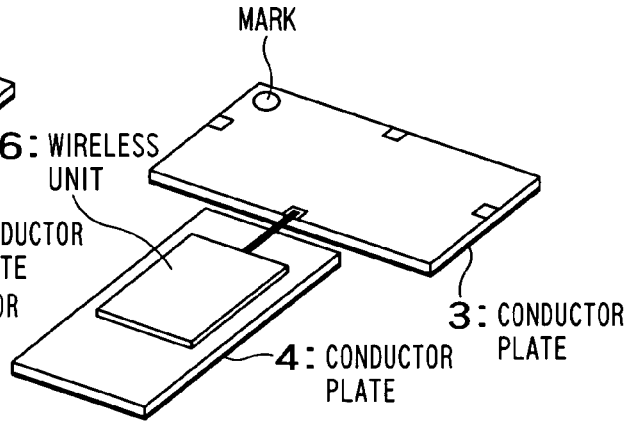
Figures 11A, 11B, 11C, 11D:
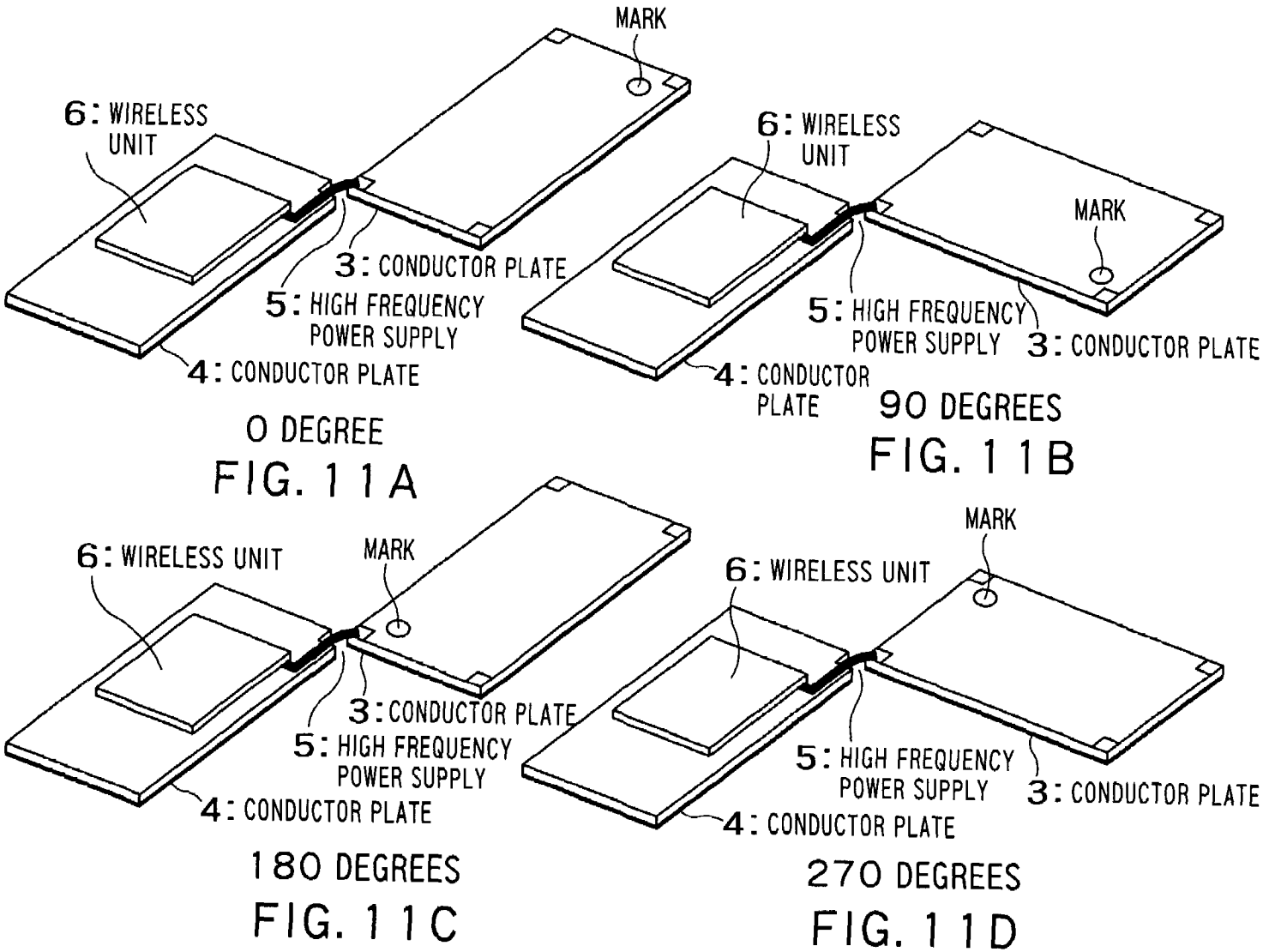
FIGS. 11A, 11B, 11C and 11D are diagrams showing arrangement patterns of conductor plates of a self-complementary antenna.

In the case of the planar dipole antenna shown in FIGS. 10A to 10D, the same characteristics are indicated in the state shown in FIG. 10A and in the state shown in FIG. 10C, whereas the same characteristics are indicated in the state shown in FIG. 10B and in the state shown in FIG. 10D. However, different antenna characteristics are indicated in the state shown in FIG. 10A (or the state shown in FIG. 10C) and in the state shown in FIG. 10B (or the state shown in FIG. 10D).

On the other hand, in the case of the self-complementary antenna shown in FIGS. 11A to 11D, substantially the same characteristics are indicated in the states shown in FIGS. 11A to 11D. This is because the antenna characteristics are little affected by the structures located outside the near field region.

In the case of the self-complementary antenna, therefore, the degree of freedom in the connection place between the conductor plate 3 and the feed line increases. This provides the sense (aspect) of the casing including the conductor plate 3 with a large degree of freedom. For example, when a display such as a liquid crystal display is mounted on the casing, the sense of the casing can be changed according to the display contents. Therefore, it becomes possible to implement an opening/closing state having a higher degree of freedom and provide a portable wireless apparatus made easier to use.

Figure 12:
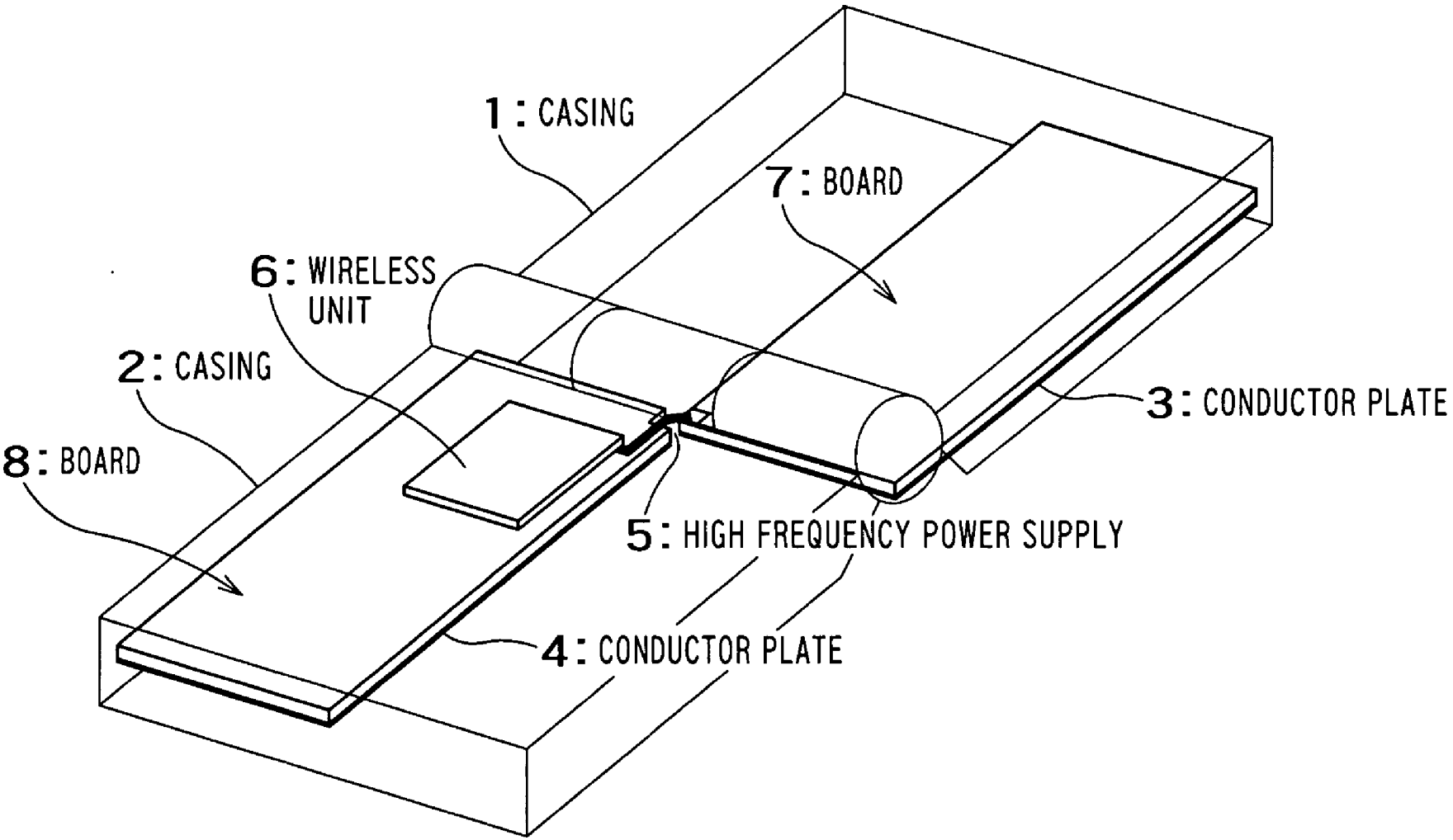
FIG. 12 is a diagram showing a configuration of a portable wireless apparatus in which casings are sufficiently larger than conductor plates.

Furthermore, in the present invention, shapes of the casings are also arbitrary. For example, as shown in FIG. 12 showing still another configuration of the portable wireless apparatus, it is also possible to make the sizes of the casings sufficiently larger than those of the conductor plates. If such a configuration is adopted, then the casings are large enough to make the display device and the input buttons large, resulting in an improved user interface.

In the present embodiment heretofore described, the conductor plate 3 and the conductor plate 4 are ground boards having the reference potential in the boards. However, it is also conducted to form the casings of conductors in order to increase the rigidity of the casings. Since in this case the casings formed of the conductors can be used as radiation elements of the antenna, the shapes of the casings themselves may be formed so as to satisfy the principle of the self-complementary antenna.

Figure 13:
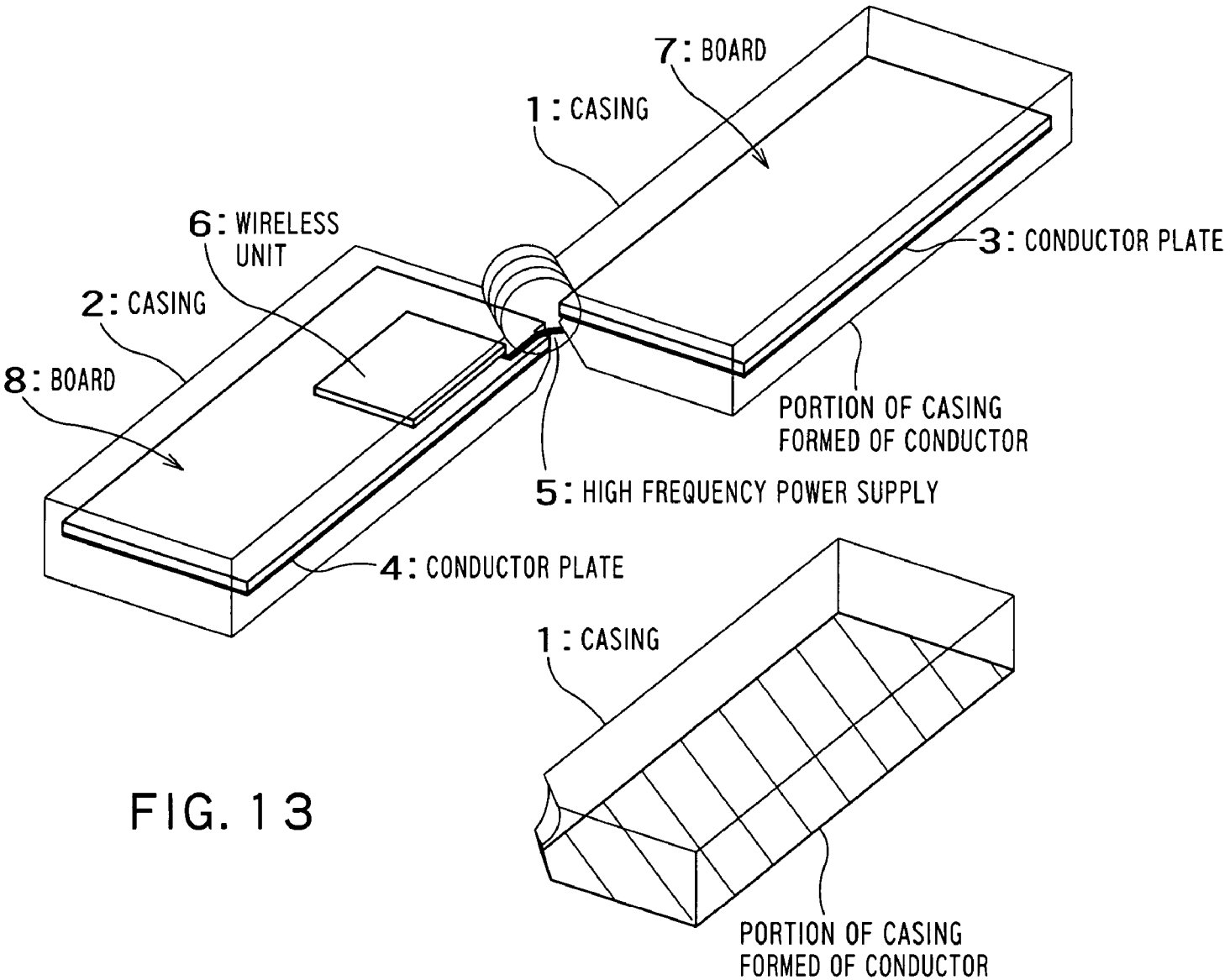
FIG. 13 is a diagram showing an example in which a part of a casing is used as a conductor plate of an antenna.

FIG. 13 shows a configuration of the portable wireless apparatus in the case where one surface of the casing 1 is formed of a conductor. The high frequency power supply 5 is connected to a portion formed of the conductor in the casing 1. This configuration also provides wideband antenna characteristics in the same way as the foregoing description.

In the present embodiment heretofore described, the conductor plate 3 or the conductor plate 4 is the same in plane shape as the dielectric board 23 or the dielectric board 24. Alternatively, the conductor plate 3 or the conductor plate 4 may be different in plane shape from the dielectric board 23 or the dielectric board 24.

Figure 14A:
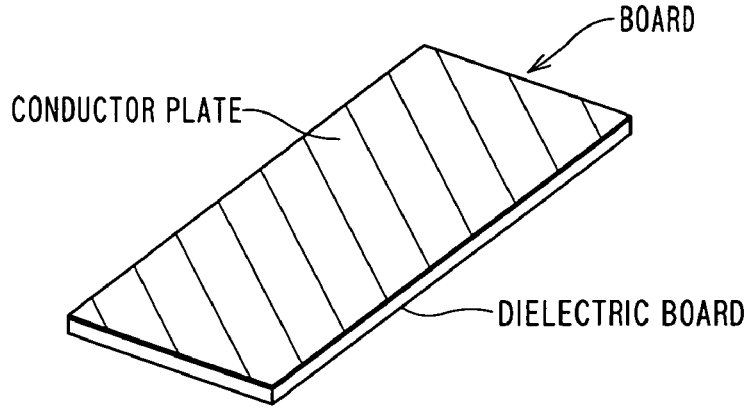
FIGS. 14A, 14B and 14C are diagrams showing relations between a conductor plate and a dielectric board.
Figure 14B:
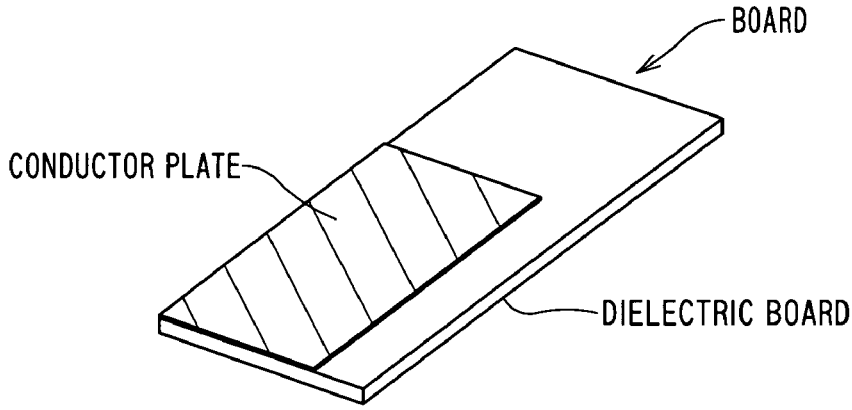
Figure 14C:
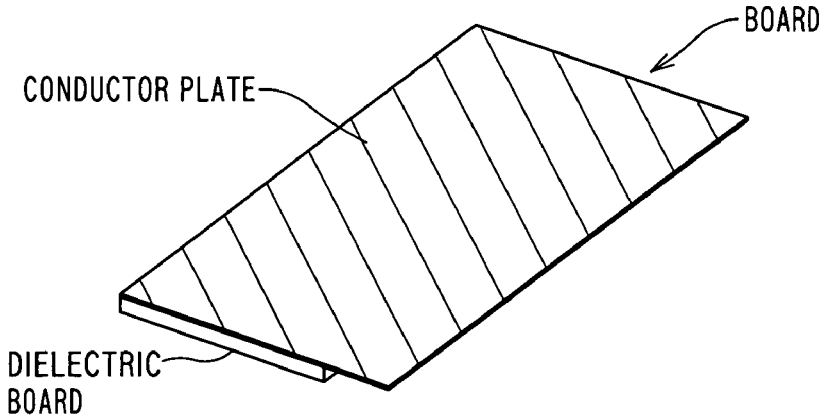

FIGS. 14A to 14C show the case where the conductor plate is equal to the dielectric board in plane shape, the case where the conductor plate is smaller than the dielectric board in plane shape, and the case where the conductor plate is larger than the dielectric board in plane shape, respectively. By the way, in FIGS. 14A to 14C, the conductor plate is shown to lie on the top of the dielectric board.

Heretofore, the present embodiment has been described by taking the portable wireless apparatus that can be folded as an example. However, the present invention can be applied to portable wireless apparatuses that can be slid-rotated or slid. Hereafter, they will be described with reference to the drawings.

Figure 15:
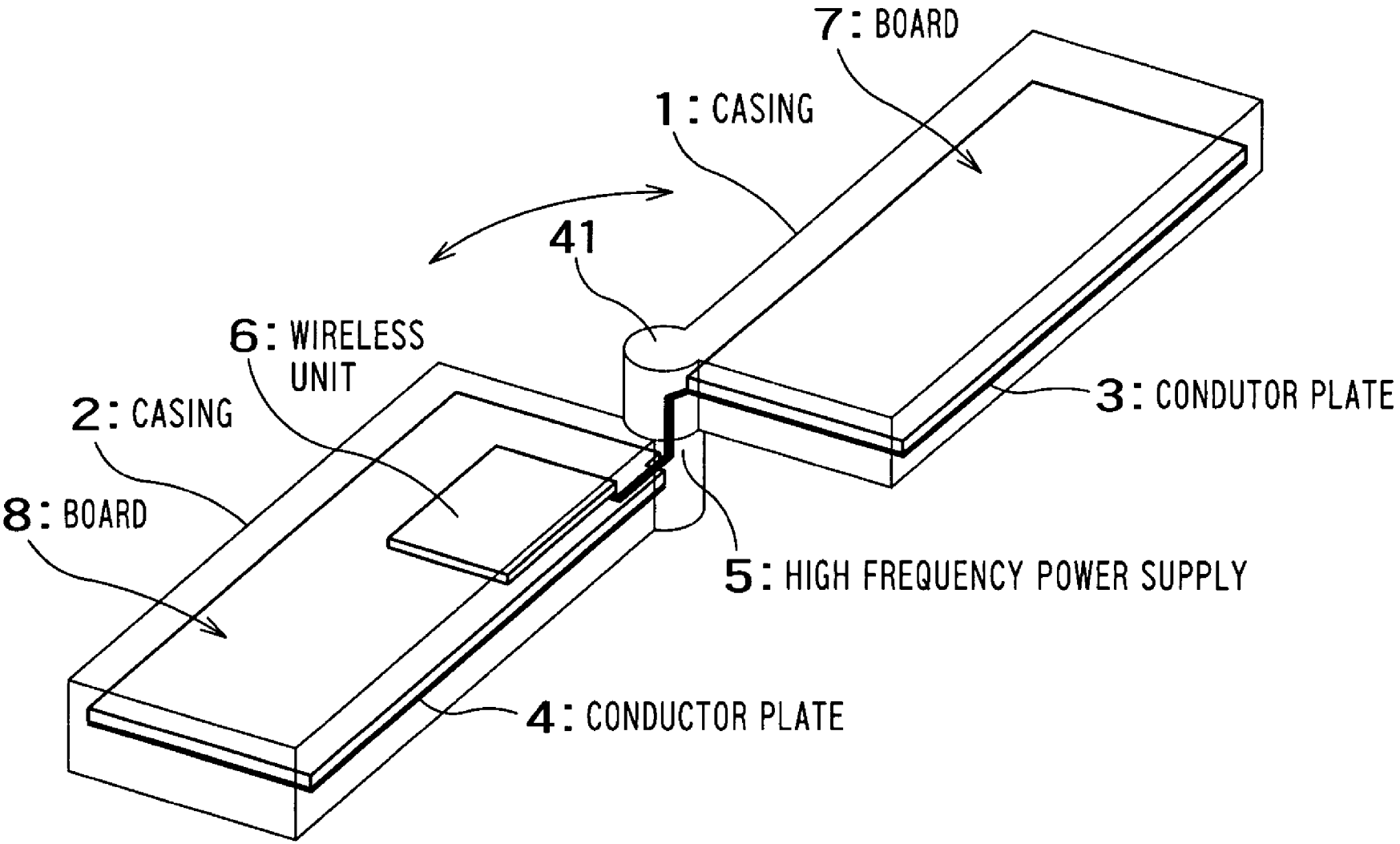
FIG. 15 is a configuration diagram of a portable wireless apparatus in which a casing is rotated to conduct opening and closing.

FIG. 15 is a diagram schematically showing a configuration of a portable wireless apparatus according to another embodiment of the present invention.

This portable wireless apparatus is configured so as to be able to opened and closed by rotating the casing 1 in parallel with the casing 2 around a rotation axis which is not illustrated. In other words, the portable wireless apparatus is opened and closed by rotating the casing 1 via a coupler 41. Since the conductor plate 4 and the conductor plate 3 are located respectively on planes having different heights, the above-described VSWR characteristics are somewhat degraded as compared with the case where they are located on the same plane.

Figure 16A:
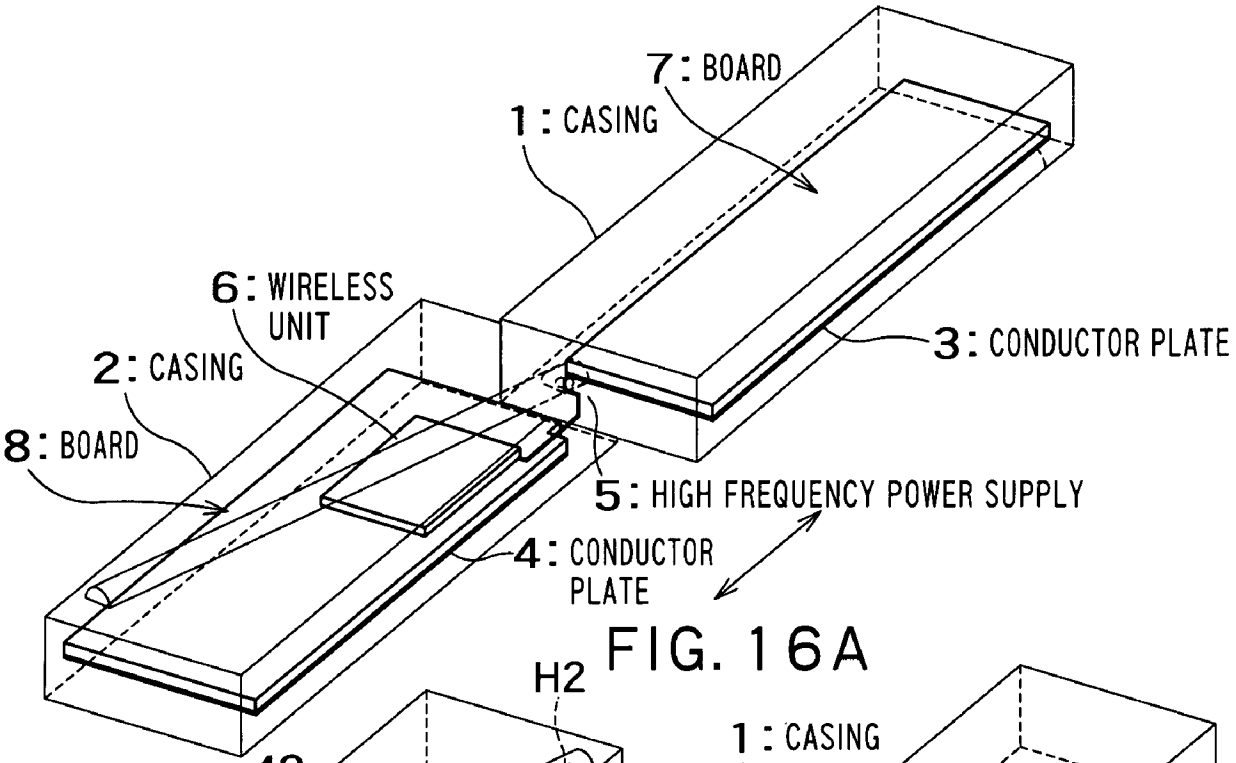
FIGS. 16A and 16B are configuration diagrams of a portable wireless apparatus in which casings are slid to conduct opening and closing.
Figure 16B:
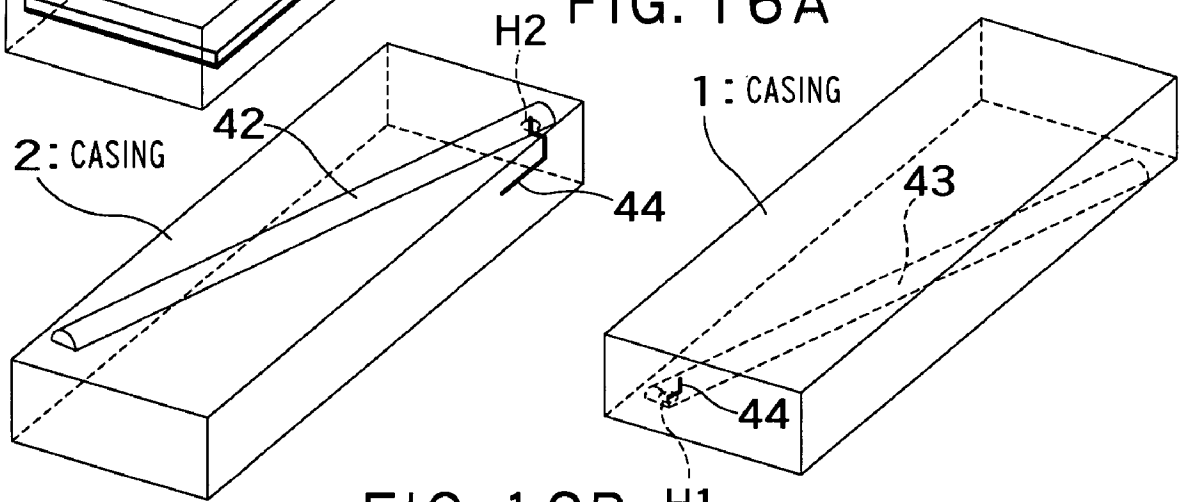

FIGS. 16A and 16B are diagrams schematically showing a configuration of a portable wireless apparatus according to yet another embodiment of the present invention.

As shown in FIG. 16A, this portable wireless apparatus is configured so as to be able to opened and closed by sliding the casing 1 with respect to the casing 2. To be more precise, the casing 1 has a concave portion 43 and the casing 2 has a convex portion 42 as shown in FIG. 16B. Opening and closing are conducted by using the convex portion 42 as a rail and sliding the casing 1. The concave portion 43 and the convex portion 42 correspond to the coupler.

In the vicinity of the high frequency power supply 5 in the open state, holes H1 and H2 are formed respectively in the concave portion 43 of the casing 1 and the convex portion 42 of the casing 2. A conductor 44 for connecting the wireless unit 6 and the conductor plate 3 is passed through the holes H1 and H2. Connection between the conductor 44 and the conductor plate 3 is conducted by contact. At the time of transition from the open state to the closed state, the conductor plate 3 is separated from the conductor 44. In this example as well, the conductor plate 4 and the conductor plate 3 are not located on the same plane in the same way as the case of FIG. 15. Therefore, the VSWR characteristics are somewhat degraded.

Figure 17A:
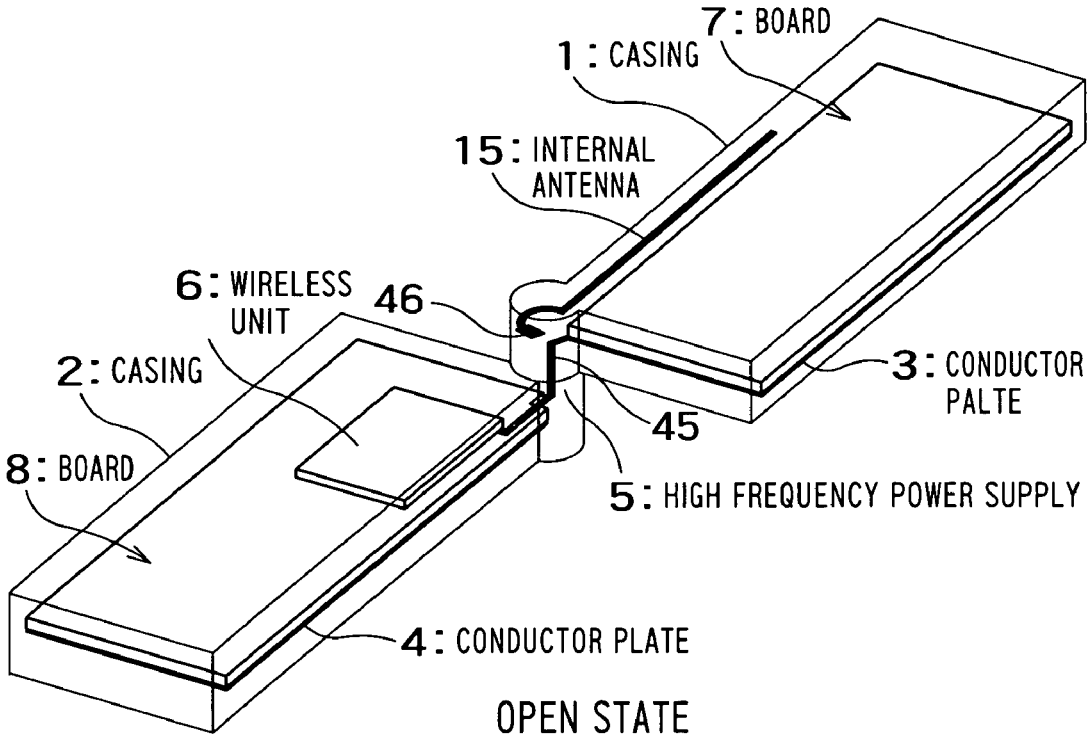
FIGS. 17A and 17B are configuration diagrams of a portable wireless apparatus including an internal antenna in a casing.
Figure 17B:
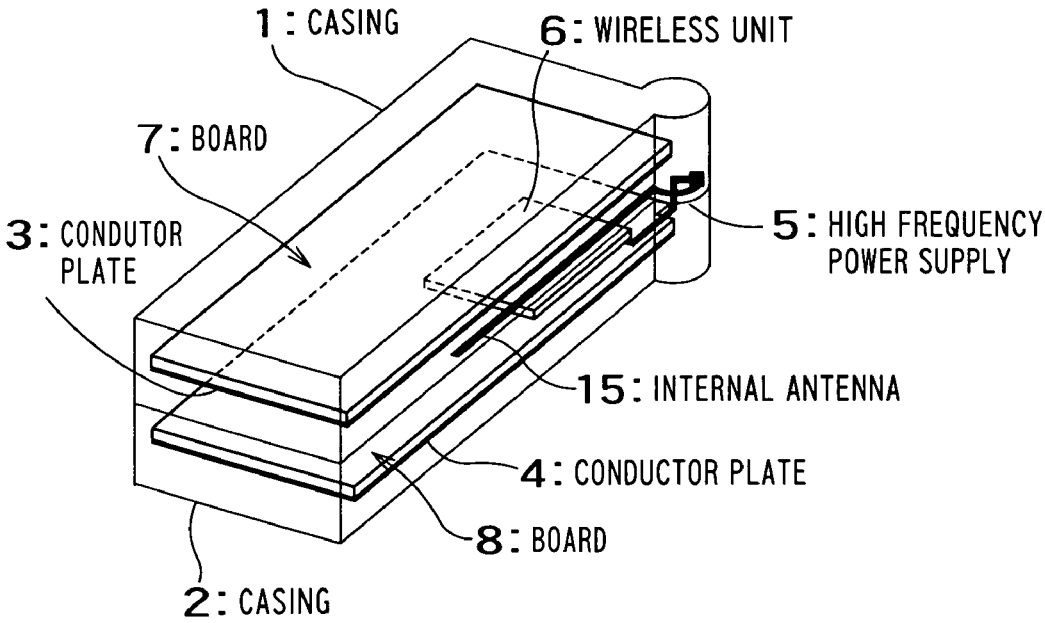

FIGS. 17A and 17B are diagrams showing a configuration of a portable wireless apparatus according to a further embodiment of the present invention.

This portable wireless apparatus has a feature that an internal antenna 15 is provided in the portable wireless apparatus shown in FIG. 15. The internal antenna 15 may be an arbitrary antenna such as a linear antenna (a wire antenna) or a planar antenna. The internal antenna 15 may be configured so as to be able to be shortened by bending or the like.

Figure 18A:
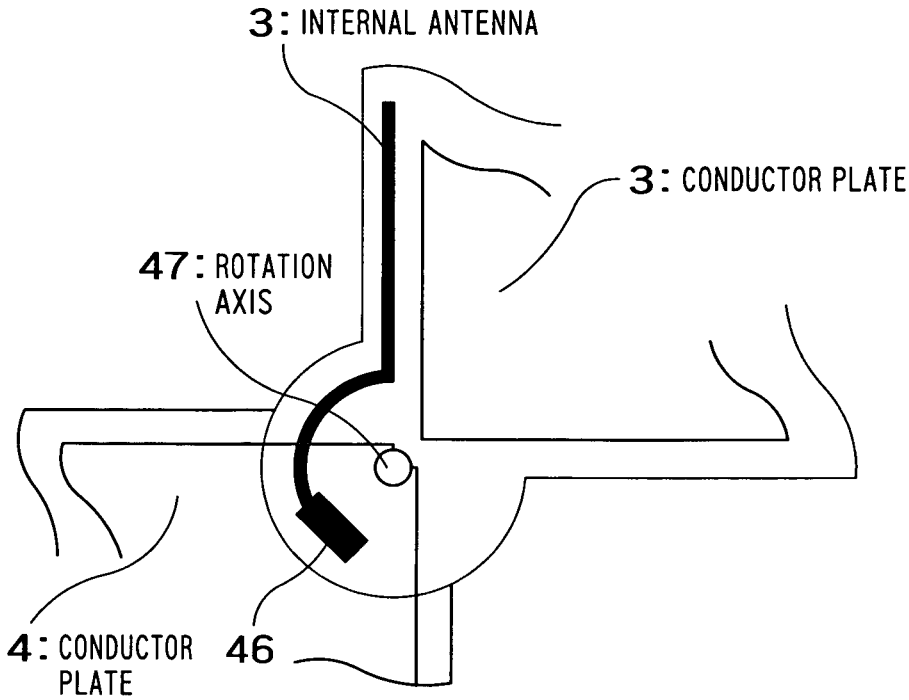
FIGS. 18A and 18B are plan diagrams of a vicinity of a high frequency power supply in a portable wireless apparatus shown in FIGS. 17A and 17B.
Figure 18B:
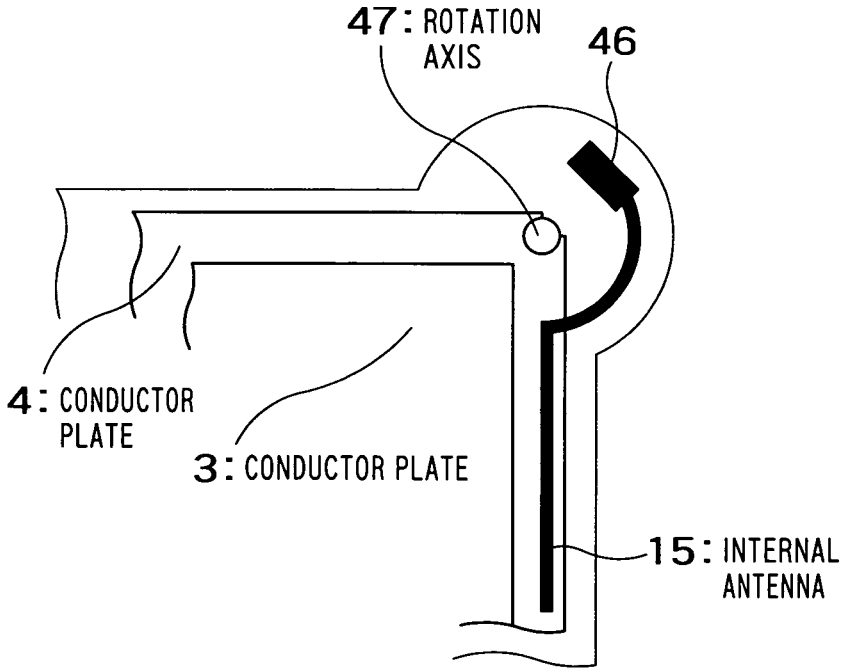

In the open state shown in FIG. 17A, the wireless unit 6 and the conductor plate 3 are connected to each other via a feed line 45, and the feed line 45 is separated from the internal antenna 15. On the other hand, in the closed state shown in FIG. 17B, the feed line 45 is separated from the conductor plate 3 and the feed line 45 is connected to the internal antenna 15. In other words, as shown in FIG. 18 which is a plan diagram showing the vicinity of the high frequency power supply 5, the internal antenna 15 includes a connection portion 46 which is separated from the feed line (not illustrated in FIG. 18) in the open state and which is brought into contact with the feed line 45 by rotating the casing 1 from the open state to the closed state around a rotation axis 47 (by, for example, 180 degrees).

When the portable wireless apparatus is opened and used in this configuration, the internal antenna 15 is not connected to the feed line 45, and consequently the internal antenna 15 does not function and the conductor plate 3 functions as the antenna. On the other hand, if the portable wireless apparatus is closed and used, the internal antenna 15 is connected to the feed line 45, and consequently the internal antenna 15 functions as the antenna and the conductor plate 3 does not function.

Even if the portable wireless apparatus is closed, it becomes possible to obtain an antenna function and it becomes possible to maintain stable antenna performance. Furthermore, it becomes possible to diversify the use state of the portable wireless apparatus and the convenience to use is improved.

Heretofore, the example in which the internal antenna is provided in the portable wireless apparatus that can be slid-rotated has been described. However, the present example can also be applied to a portable wireless apparatus that can be folded or slid.

In the foregoing description, the portable wireless apparatus has two casings. However, the present invention can also be applied to a portable wireless apparatus having three or more casings, in the same way. In this case, the present invention should be applied between two arbitrary adjacent casings. In the case where three or more casings are included, it becomes possible to implement a plurality of antennas on one portable wireless apparatus by applying the present invention to a plurality of places. It becomes possible to implement antenna functions, such as a diversity antenna, beamforming, interference wave suppression, an adaptive antenna, radio wave arrival direction estimation, and a radar function, by using a plurality of antennas. By the way, such functions can also be implemented using the conductor plates incorporated in the portable wireless apparatus. As a result, it is facilitated to reduce the cost and size and widen the band.

As a matter of course, the present invention can be applied to a folded game machine having a game function. When playing a network game, therefore, stable and favorable wireless communication can be maintained.

What is claimed is:

1. A portable wireless apparatus comprising:

a first casing including a first conductor plate;

a second casing including a second conductor plate;

a coupler which couples the first casing and the second casing; and a feed point which feeds power to the first and second conductor, disposed in close vicinity to the coupler, wherein the first casing and the second casing are rotatable around the feed point, and wherein when the first and second conductor plates are rotated in same direction by 90 degrees around the feed point taken as a fulcrum in a state in which the two casings are opened to each other, the first and second conductor plates substantially coincide with shapes sandwiched between the first and second conductor plates before the rotation.

2. The portable wireless apparatus according to claim 1, wherein when the first and second conductor plates are rotated in the same direction by 90 degrees, then at least in a circle having the feed point as a center and having a radius which is at least one fourth of a wavelength corresponding to a lowest frequency in a frequency band in use, the first and second conductor plates substantially coincide with shapes of spaces sandwiched between the first and second conductor plates before the rotation.

3. The portable wireless apparatus according to claim 2, wherein when the first and second conductor plates are rotated in the same direction by 90 degrees, then at least outside a circle having the feed point as a center and having a radius which is one tenth or less of a wavelength corresponding to a highest frequency in the frequency band in the use, the first and second conductor plates substantially coincide with shapes of spaces sandwiched between the first and second conductor plates before the rotation.

4. The portable wireless apparatus according to claim 1, wherein when the first and second conductor plates are rotated in the same direction by 90 degrees, then at least outside a circle having the feed point as a center and having a radius which is one tenth or less of a wavelength corresponding to a highest frequency in the frequency band in the use, the first and second conductor plates substantially coincide with shapes of spaces sandwiched between the first and second conductor plates before the rotation.

5. The portable wireless apparatus according to claim 1, further comprising a feed line to feed to the feed point.

6. The portable wireless apparatus according to claim 5, further comprising an impedance conversion circuit between the feed line and the feed point.

7. The portable wireless apparatus according to claim 5, wherein the feed line includes a coaxial line or a microstrip line.

8. The portable wireless apparatus according to claim 5, wherein the first or second casing includes an internal antenna inside, and when two casings are closed to each other, the feed line is separated from the feed point and connected to a feed point of the internal antenna.

9. The portable wireless apparatus according to claim 1, wherein the coupler is configured so as to be able to fold the two casings to each other.

10. The portable wireless apparatus according to claim 1, wherein the coupler is configured so as to be able to slide the second casing with respect to the first casing.

11. The portable wireless apparatus according to claim 1, wherein the coupler is configured so as to be able to slide and rotate the second casing with respect to the first casing.

12. The portable wireless apparatus according to claim 1, wherein, in a state in which the two casings are opened to each other, the first and second conductor plates are located on same plane.

* * * * *